US012543803B1

(12) United States Patent
Highsmith

(10) Patent No.: US 12,543,803 B1
(45) Date of Patent: Feb. 10, 2026

(54) NURSING DEVICE

(71) Applicant: Brittney Lauren Highsmith, Summit, NJ (US)

(72) Inventor: Brittney Lauren Highsmith, Summit, NJ (US)

( * ) Notice: Subject to any disclaimer, the term of this patent is extended or adjusted under 35 U.S.C. 154(b) by 0 days.

(21) Appl. No.: 18/798,182

(22) Filed: Aug. 8, 2024

(51) Int. Cl.
*A41D 1/215* (2018.01)

(52) U.S. Cl.
CPC ..... *A41D 1/215* (2018.01); *A41D 2300/32* (2013.01); *A41D 2400/42* (2013.01)

(58) Field of Classification Search
CPC ..... A41D 1/215; A41D 1/21
USPC ..... 36/104
See application file for complete search history.

(56) References Cited

U.S. PATENT DOCUMENTS 677,010 A * 6/1901 Ziller ..... A41B 13/103 2/49.2
4,594,735 A 6/1986 Rolf et al.
5,259,068 A * 11/1993 Carroll ..... A41D 1/215 2/104
5,671,479 A * 9/1997 Dedrick ..... A47G 23/06 2/259
8,418,295 B2 4/2013 Clark
8,763,621 B2 7/2014 Jin
9,057,206 B2 6/2015 Lin
11,399,577 B2 8/2022 Akerson et al.
2010/0186137 A1 7/2010 Gutshe

* cited by examiner

*Primary Examiner* — Timothy K Trieu
(74) *Attorney, Agent, or Firm* — Wilmer Cutler Pickering Hale and Dorr LLP

(57) ABSTRACT

Embodiments of a nursing device are disclosed. In a non-limiting embodiment, the nursing device is collapsible from an open configuration to a collapsed configuration. A wall extends along front and side portions of the device. The wall has an upper rim and a lower rim. A flexible frame is provided that has an upper leg adjacent the upper rim and a lower leg adjacent the lower rim. A cover portion is attached to the wall and at least partially defines a viewing window. In the open configuration, the frame is biased to an expanded state that extends the cover portion in an outwardly direction to define an interior cavity between the cover portion and the wall. In the collapsed configuration, the frame is folded onto itself.

33 Claims, 16 Drawing Sheets

NURSING DEVICE

FIELD OF THE DISCLOSURE

Embodiments of the disclosure relate to nursing devices. In some non-limiting implementations, the disclosure relates to covers for mothers to use while nursing a baby.

BACKGROUND OF THE DISCLOSURE

Breastfeeding is an important aspect of child development. Ensuring optimal conditions for both mother and baby is crucial for a successful breastfeeding journey. Factors such as the lack of privacy and inadequate feeding environments pose challenges to the breastfeeding experience. It can be difficult to find a public location where a mother can feel relaxed and position the baby in a manner that encourages latching.

The most common approach to public breastfeeding is to hold a piece of material to cover the baby and the mother's breasts. Current nursing covers typically include simple pieces of cloth, similar to a smock. These covers require using one hand to hold up the cloth leaving only one hand for other tasks. This approach is problematic for many people, including people with lactation challenges and/or large breasts.

Cradling a baby when nursing is best done with two hands to separately support the baby's head and body. This may be complicated by a mother needing to manipulate a breast with one hand to induce lactation. It is challenging for a mother to perform these tasks when one hand needs to prop up a cloth. To make matters worse, feeding sessions can extend for long periods of time, causing the mother to fatigue when trying to provide adequate cover, cradle the baby, and induce lactation. These issues can cause stressful and uncomfortable situations for mother and baby, often leading to an unsuccessful feeding session. All of these unfortunate conditions are further complicated by the need to feed a baby multiple times per day.

SUMMARY OF THE DISCLOSURE

Embodiments of a nursing device are disclosed. A nursing device is provided that is collapsible from an open configuration to a collapsed configuration. A wall extends along front and side portions of the device. The wall has an upper rim and a lower rim. A flexible frame is provided that has an upper leg adjacent the upper rim and a lower leg adjacent the lower rim. A cover portion is attached to the wall and at least partially defines a viewing window.

In the open configuration, the frame is biased to an expanded state that extends the cover portion in an outwardly direction to define an interior cavity between the cover portion and the wall. In the collapsed configuration, the frame is folded onto itself. In the open configuration, the wall is forced downwardly to block a nursing child from being seen from at least a front and sides of the nursing device.

In some embodiments, the frame in the open configuration forms an oval loop with curved end portions. The upper leg may extend between tops of the curved end portions and the lower leg may extend between bottoms of the curved end portions. In some embodiments, the frame forms a single continuous loop in the open configuration and forms two adjacent loops in the collapsed position.

In some embodiments, a center of the frame is at a front portion of the nursing device, and the wall is split to create an opening opposite the front portion. The opening may be defined by opposing ends of the wall, and a fastener may be used to adjust an amount of space between the opposing ends. In some embodiments, the fastener comprises a string that extends through holes in the wall to form a zigzag pattern.

The viewing window may have a curved circumferential rim for surrounding a user's neck. The viewing window may be defined, in part, by straps that extend from the cover portion. The straps may be releasably attached to each other. In some embodiments, the viewing window has a rim, such that an open space exists between a back portion of the rim and the opposing ends of the wall.

Also provided is a collapsible nursing device that includes a frame comprising a plurality of segments. A plurality of coupling assemblies are provided that couple the plurality of segments, and a cover portion including a viewing window is attached to the frame to.

A wall of the nursing device extends along a front and sides of the frame. The wall may comprise a first end and a second end that are separated to define a space at a rear of the device. In an open configuration, the coupling members are biased to an expanded state that forces the segments away from each other such that the cover portion extends outwardly to define an interior cavity between the cover portion and the wall. In some embodiments, the coupling assemblies respectively include a biasing member that exerts force to push the coupling members to the open configuration.

In a collapsed configuration, the coupling members are in a contracted state such that at least two of the segments are folded onto each other, while the cover portion and the wall remain attached to the frame. In some embodiments, a frame fastener may be used to hold the segments in place while in the collapsed configuration.

The present disclosure will now be described in more detail with reference to particular embodiments thereof as shown in the accompanying drawings. While the present disclosure is described below with reference to particular embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein.

BRIEF DESCRIPTION OF THE DRAWINGS

Various objectives and features of the disclosed subject matter can be more fully appreciated with reference to the following detailed description of the enclosed subject matter when considered in connection with the following drawings, in which like reference numerals identify like elements. The following drawings should not be construed as limiting the present disclosure and are intended to be illustrative only.

DETAILED DESCRIPTION OF EMBODIMENTS

Figure 1:
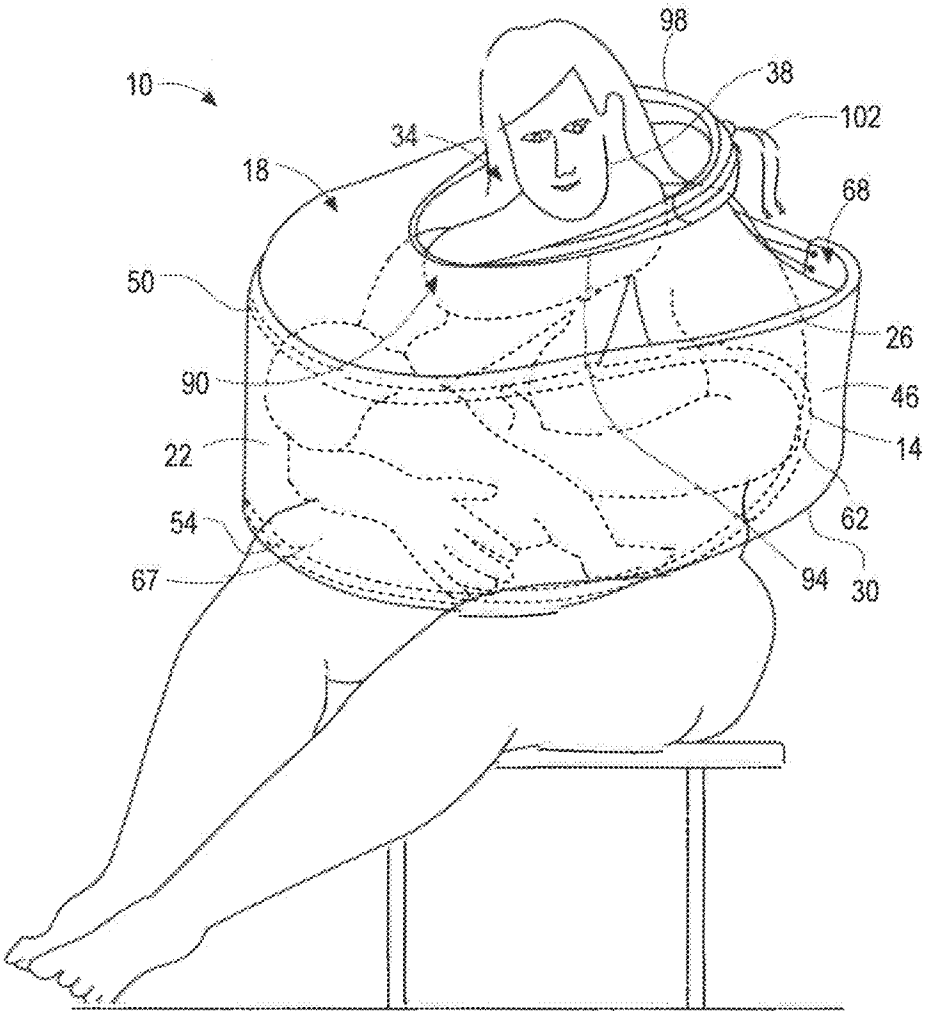
FIG. 1 illustrates a perspective view of a nursing device being worn by a user according to a non-limiting embodiment.

FIG. 1 illustrates an embodiment of a nursing device 10 that includes a flexible frame 14, a cover portion 18, and a wall 22. The wall 22 has an upper rim edge 26 and a lower rim edge 30. The cover portion 18 includes a viewing window 34 that extends around a user's neck 38 to mount the nursing device 10 and permit a user to view a baby while nursing. Embodiments of the disclosure allow the user to find a comfortable nursing position while being able to see the baby's mouth and the user's nipple, making the latching process more successful and efficient. As shown, the user's hands are free to support the baby and induce lactation as needed.

Figure 2:
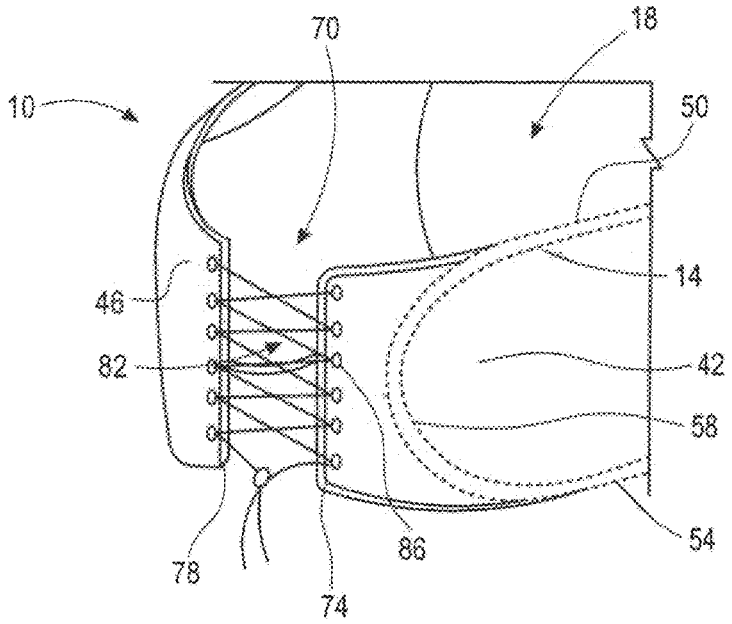
FIG. 2 illustrates a perspective view showing a rear portion of the nursing device in FIG. 1 according to a non-limiting embodiment.

With additional reference to FIG. 2, the frame 14 may have an oval shape that extends from a first side portion 42 of the wall 22 to a second side portion 46 of the wall 22. The frame 14 has an upper leg 50 adjacent the upper rim edge 26 and a lower leg 54 adjacent the lower rim edge 30. The frame 14 also has two curved end portions 58, 62 disposed on the first and second side portions 42, 46 respectively. The upper leg 50 extends between tops of the curved end portions 58, 62, and the lower leg 54 extends between bottoms of the curved end portions 58, 62. In an embodiment, the upper leg 50 of the frame 14 is parallel to the upper rim edge 26 of the wall 22 along the entire length of the upper leg 50 or at least a portion of the upper leg 50. Similarly, the lower leg 54 of the frame 14 may be parallel to the lower rim edge 30 of the wall 22 along the entire length of the lower leg 54 or at least a portion of the lower leg 54. In an embodiment, the frame 14 is symmetrically positioned on the wall 22. The frame 14 is shown in FIGS. 1 and 2 as being behind the wall 22; however, it will be appreciated that the frame 14 may alternatively be secured to an outer face of the wall 22.

The curved end portions 58, 62 of the frame 14 are disposed on the first and second sides portions 42, 46, respectively, such that the frame 14 wraps around a front of the user and terminates at left and right sides of the user. In an embodiment, a height of the frame 14 is defined by a distance between the upper rim edge 26 and the lower rim edge 30, and the length of the frame is defined by a distance between apexes of the curved end portions 58, 62. As shown in FIGS. 1 and 2, the length may be greater than the height to provide circumferential support for the device 10 and usefully create an interior cavity 67 sized to allow sufficient room for the user to cradle and feed the baby. Accordingly, the interior cavity 67 extends in front of the user and is designed specifically to enhance the breastfeeding experience. In an embodiment, the frame 14 comprises a wire material that can be formed into a predefined shape, such as a circle, oval, and similar shapes, while having the flexibility to take other shapes when acted on by force and to revert back to an original shape when the force is removed.

The frame 14 may be attached to the wall 22 in various ways. For example, the frame may be attached to the wall 22 using an adhesive, including adhesives that are non-toxic or otherwise do not cause a nursing mother or a baby to have an adverse reaction. As another example, a sleeve may be integrated with the wall 22 to house the frame 14. The sleeve may be sewn to the wall or attached with adhesive so that it follows the shape of the frame 14 shown in FIG. 1 and is sized with an internal area slightly larger than the frame 14 to provide a snug fit. In an embodiment, the sleeve is attached to an outside face of the wall 22. Alternatively, the sleeve may be attached to an inside area of the wall 22.

The cover portion 18 is attached to the wall 22 at an area adjacent the upper rim edge 26 to form a roof over the interior cavity 67. The cover portion 18 may be sewn or otherwise attached to the wall 22 using adhesive, including non-toxic adhesives. The cover portion 18 may be attached slightly below the upper rim edge 26 to form a gap 68 between the cover portion 18 and the upper rim edge 26.

In an embodiment, the cover portion 18 and the wall 22 may be constructed from a unitary piece of material or may comprise multiple pieces of material that are sewn or otherwise attached together. Examples of materials used for the cover portion 18 and the wall 22 include, but are not limited to, cloth, woven fabric, silk, rayons, acetate, polyester and the like. The material(s) may be opaque to increase privacy of the user and baby. Materials having different levels of transparency may be used depending on an amount of light that should be allowed into the interior cavity 67. Mesh or porous materials may also be used to enhance breathability.

With further reference to FIG. 2, the wall 22 is split to create a gap 70 at the rear of the device 10. The cover portion 18 may also be split to form an opening above the gap 70. The gap 70 is defined by opposing termination ends 74, 78 of the wall 22. The size of the gap 70 may be adjusted by pulling the termination ends 74, 78 closer to each other or pushing them further apart. A fastener 82 is attached to the termination ends 74, 78 to adjust a size of the gap 70. The fastener 82 may comprise string that extends through holes 86 to form a zigzag pattern. The fastener 82 helps pull the side portions 42, 46 to a rear of the device 10 to provide additional privacy from onlookers behind the user and to also provide adjustability to change the size of the device 10 to fit different body types. Other forms of fasteners may be used, such as zippers, buttons, hook and loop fasteners, and the like.

The viewing window 34, shown in FIG. 1, is defined by a recessed area 90 of the cover portion 18 and includes a rim 94. The viewing window 34 is sized to permit the user's neck 38 to extend therethrough and allow the user to have a light of sight to the nursing baby. In an embodiment, the cover portion 18 adds to the interior cavity 67 by extending in a non-vertical manner from a front of the rim 94 to the upper rim edge 26 of the wall 22 to provide a roof like structure. An angle between the cover portion 18 and a central area of the upper rim edge 26 in front of the user may be 50 degrees or less. In an embodiment, this angle may be between 0-30 degrees. The roof like structure and the wall 22 configuration, discussed above, contribute to features of the device 10 by providing ample interior cavity 67 space in comparison to other wearable items that do not provide such a cavity.

The rim 94 may have a fastening configuration positioned toward a rear of the device 10 that includes a strap or a plurality of straps 98 that can be adjusted. The straps 98 may be secured to each other using, for example, hook and loop fasteners, buttons, and the like. A circumference of the rim 94 can be adjusted by changing an amount that the straps 98 overlap with each other. In addition or alternatively, a drawstring 102 can be used to adjust the circumference of the rim 94. For example, if a user wants the rim 94 of the viewing window 34 to have a greater circumference, the straps 98 can be fastened to each other in a manner that has less overlap and/or the drawstring 102 can be loosened. Changing the size of the viewing window 34 may be useful for adjusting how well the device 10 fits the user and/or changing the field of view with respect to the baby and the user's breasts.

Exemplary materials for the frame 14 include low carbon iron wire, galvanized iron wire, stainless steel wire, 65Mn steel wire, copper coated wire, and the like. Other suitable materials, such as flexible plastics may be used. In an embodiment, the frame 14 is made of a wire type sufficiently light-weight to allow the nursing device 10 to collapse by twisting and bending motions and yet have sufficient strength to expand automatically when unfolded to be self-supporting. In embodiments, the frame 14 may have a thickness of 0.250 mm-5.33 mm and a width of 1.5 mm-19 mm. The frame 14 may have various cross-sectional shapes, such as rectangular, square, triangle, semicircle, oval, and the like. In some embodiments, a height of the wall 22 in the open configuration is approximately 45 cm and a widest portion of the device 10 from side-to-side may be 55 cm-66 cm. As a further example, a distance from a frontmost portion of the wall 22 to the gap 70 between the opposing termination ends 74, 78 may be between 55 cm-66 cm.

Figure 3:
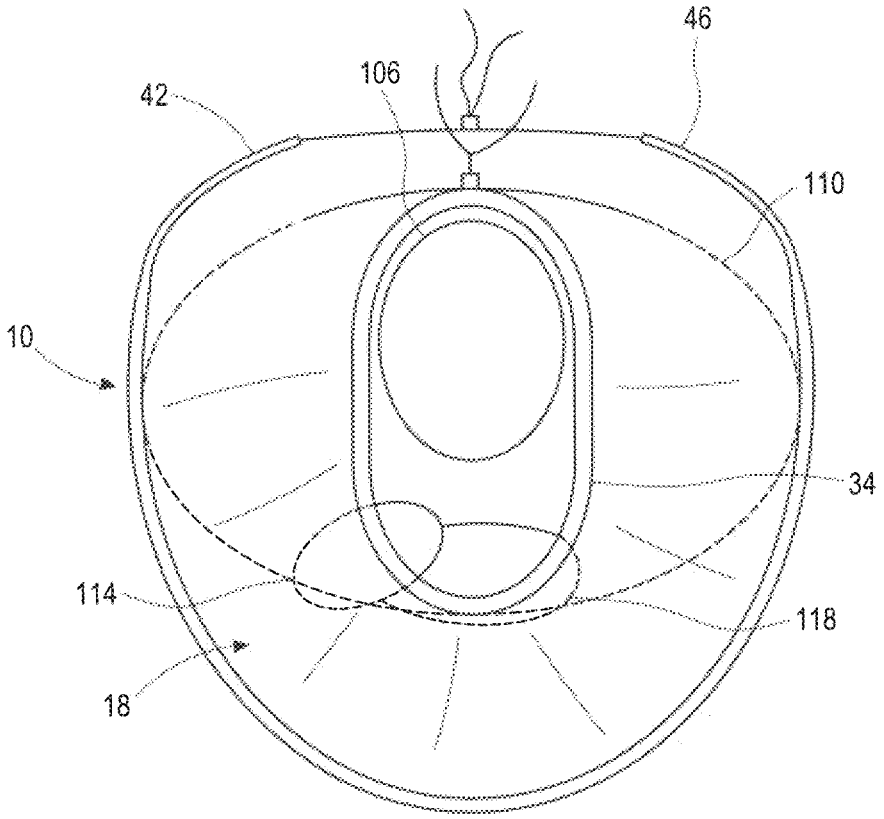
FIG. 3 illustrates a top view of the nursing device in FIG. 1 with silhouettes of a mother and baby according to a non-limiting embodiment.

FIG. 3 depicts boundary areas of the user and baby. For example, boundary area 106 represents the user's head, boundary area 110 represents the user's body and breast area, boundary area 114 represents the baby's head, and boundary area 118 represents the baby's body. The cover portion 18 provides privacy for the baby 114, 118, and the user's body 110, while the viewing window 34 permits the user to see the baby 114, 118 and breast area during a feeding session. The ability to sufficiently see the baby 114, 118 helps the user guide the baby's mouth to latch properly onto the breast, and the added air flow allows the user and baby to stay comfortable, which increases the chance of having a successful feeding session. The interior area of the nursing device 10 provides sufficient space for the baby 114, 118 and allows the user to move their arms and reposition the baby 114, 118 as needed. The interior area also allows the user to use both hands for cradling the baby 114, 118 without having to dedicate a hand to holding a sheet in place, which is distracting for both user and baby. In embodiments, the interior area is sufficient for twins, babies that are older, and plus size users.

The nursing device 10 is collapsible from an open configuration to a collapsed configuration. This allows the device 10 to be easily stored and transported. The device 10 can also be easily expanded from the collapsed configuration to quickly provide privacy and comfort for a feeding session. The frame 14 forms a sufficiently rigid structure that is flexible enough to allow the nursing device 10 to collapse and rigid enough to keep the device 10 free standing during use.

Figure 4:
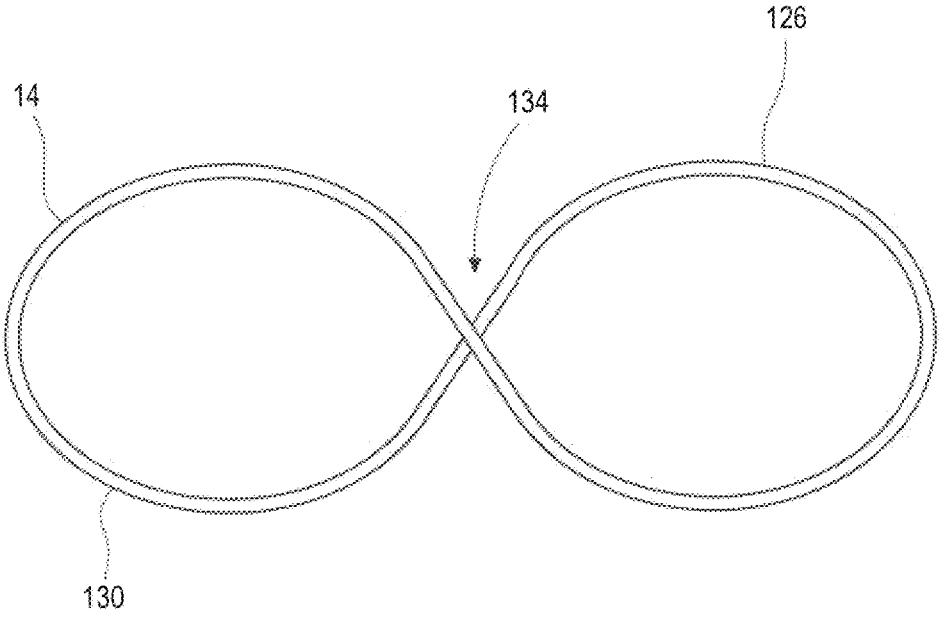
FIG. 4 illustrates the nursing device in FIG. 1 being transformed to a collapsed position according to a non-limiting embodiment.

The nursing device 10 can be placed into the collapsed position by grasping the curved end portions 58, 62 of the frame 14 and twisting them in opposite directions to put the frame 14 into a figure eight configuration. FIG. 4 illustrates an example of this configuration, showing the twisted frame 14 in isolation with two loops 126, 130 that meet at a common point 134. The loops 126, 130 may then be folded to stack on top of each other. It will be appreciated that the cover portion 18 and wall 22, discussed above, can remain attached to the collapsed frame 14. In an embodiment, the frame 14 is separable from the wall 22 to facilitate cleaning the nursing device 10 in a washing machine or as an alternative form of storage. For example, a removable sleeve for housing the frame 14 may be attached to the wall 22 using hook and look fasteners, such that at least a portion of the sleeve can be pulled away from the wall 22 for allowing the frame 14 to be removed.

Figure 5:
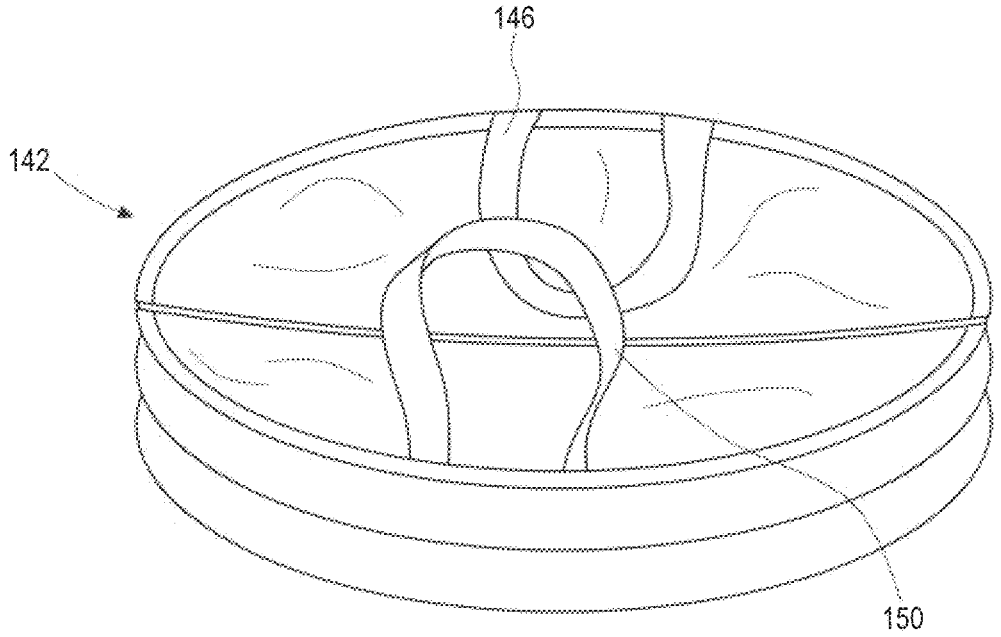
FIG. 5 illustrates a storage bag for a collapsed nursing device according to a non-limiting embodiment.

The device 10 may remain in the collapsed configuration until the loops 126, 130 are permitted to unfold to the original position of the frame 14 shown in FIG. 1. This allows the device 10 to be quickly and easily transitioned from the collapsed position to the expanded position to provide privacy and comfort in a public setting or in any situation where users desire to shield themselves and their babies from onlookers. As shown in FIG. 5, the collapsed device 10 may be placed within a storage bag 142 having handles 146, 150.

Figure 6:
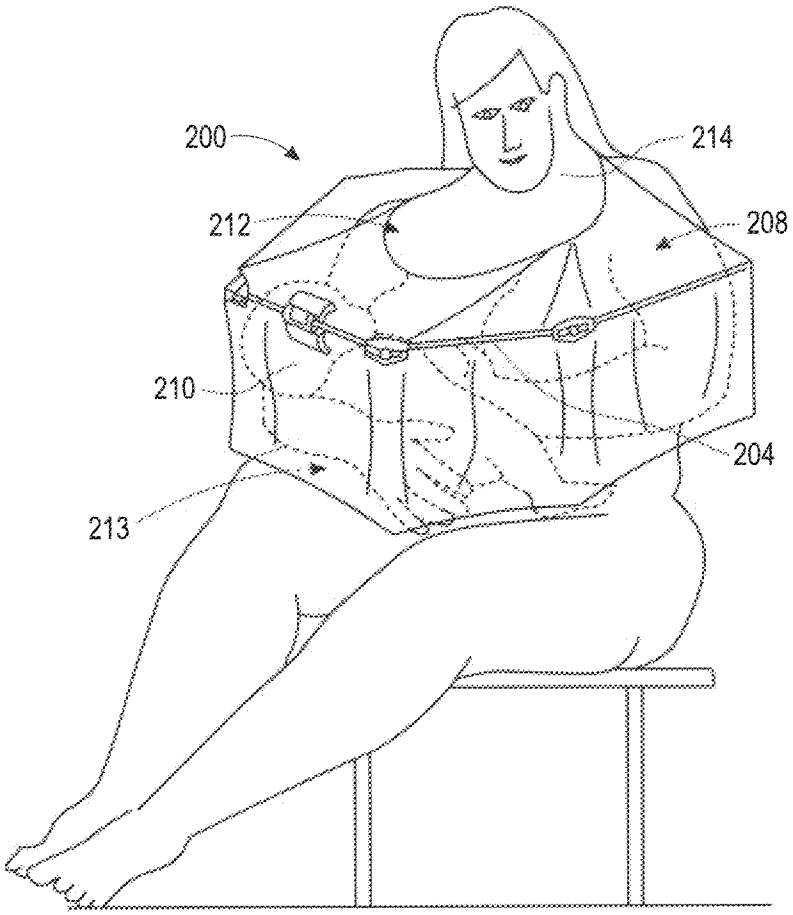
FIG. 6 illustrates a perspective view of a nursing device being worn by a user according to a non-limiting embodiment.

FIG. 6 illustrates an embodiment of a nursing device 200 that includes a frame 204 attached to a cover portion 208 and a wall 210 to form an interior cavity 213. The cover portion 208 includes a viewing window 212 that extends around a user's neck 214 to mount the nursing device 200 and permit the user to view a baby while nursing.

Figure 7:
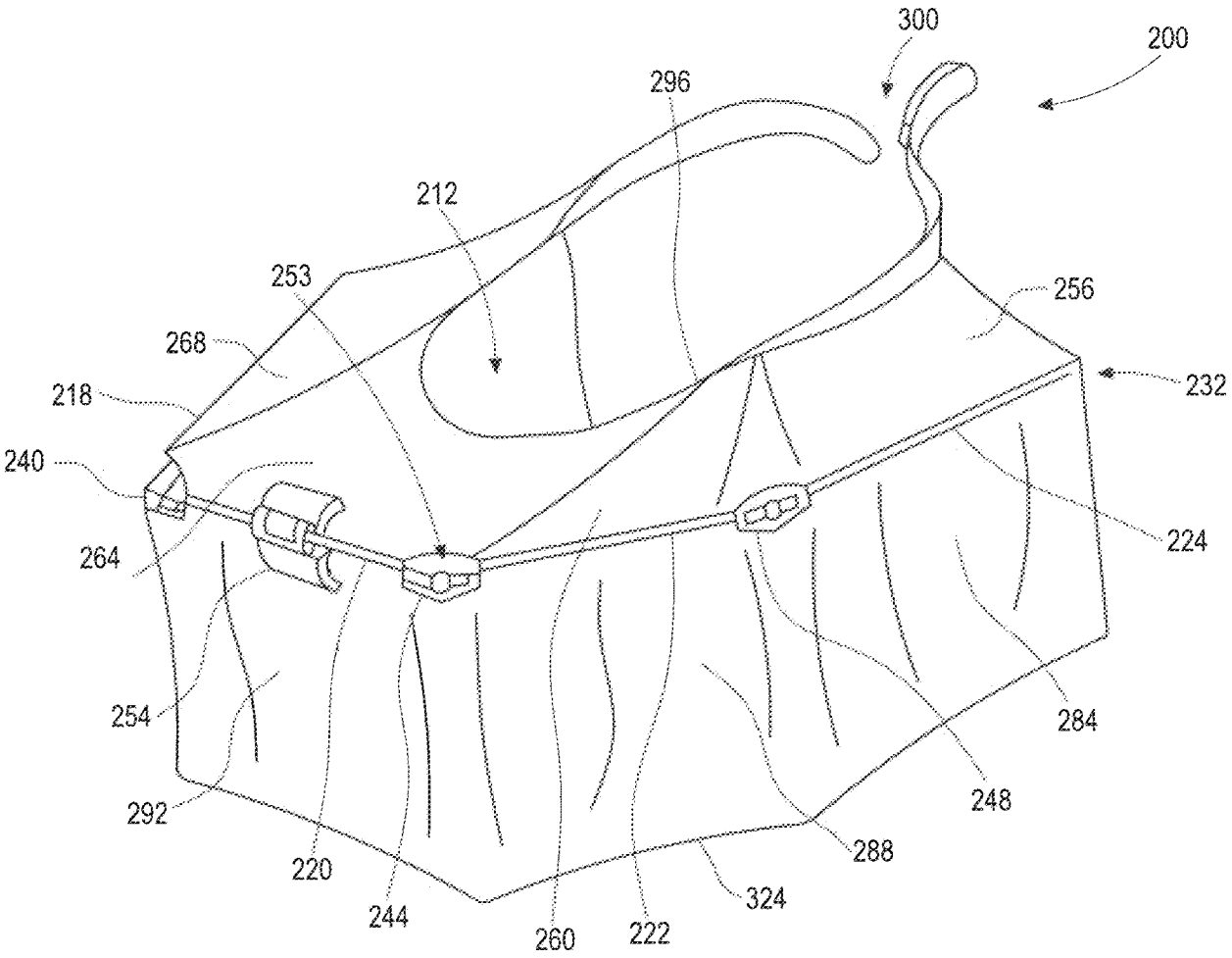
FIG. 7 illustrates a perspective view of the nursing device in FIG. 6.
Figure 8:
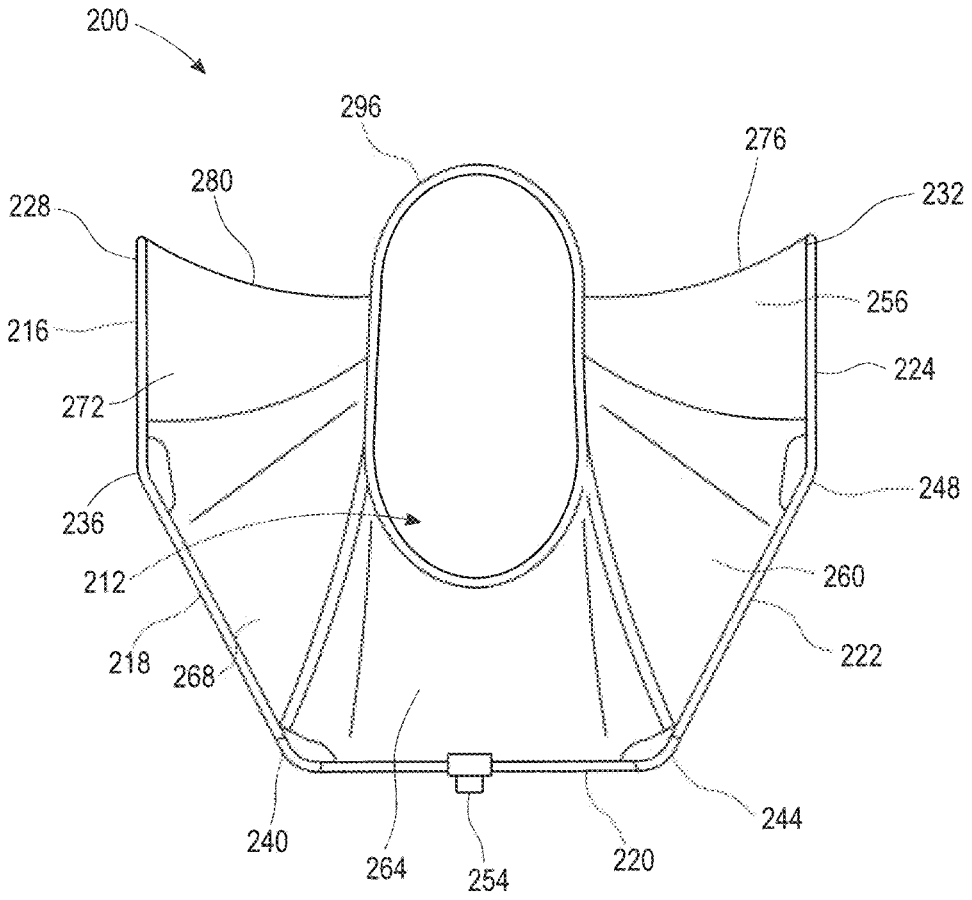
FIG. 8 illustrates a top view of the nursing device in FIG. 7 according to a non-limiting embodiment.

With additional reference to FIGS. 7 and 8, the frame 204 is formed from multiple segments 216, 218, 220, 222, 224 that are connected to each other. The segments 216, 218, 220, 222, 224 may be in the in the form of poles and may be hollow to reduce weight. In an embodiment, the segments 216, 218, 220, 222, 224 are constructed of a suitable material that is lightweight and sufficiently ridged to support the cover portion 208 and wall 210, such as plastic, polypropylene, alloy, aluminum, carbon fiber, wood, steel and the like. It will be appreciated that more or less segments can be used.

The frame 204 has an arched shape that wraps around a front of the user. In an embodiment, the frame 204 has two termination ends 228, 232, shown in FIG. 8, located at sides of the device 200. During use, termination end 228 is located adjacent to a right shoulder of a user and termination end 232 is located adjacent to a left shoulder of the user.

The frame segments 216, 218, 220, 222, 224 are attached to each other with coupling assemblies 236, 240, 244, 248. In an embodiment, the frame segments 218, 220, 222 have a coupling assembly on each end, and frame segments 216, 224, respectively, have a coupling assembly on only one end. The coupling assemblies 236, 240, 244, 248 may each include a biasing member, such as a spring or other component, that forces the segments 216, 218, 220, 222, 224 into the positions shown in FIGS. 6-8.

Figure 9:
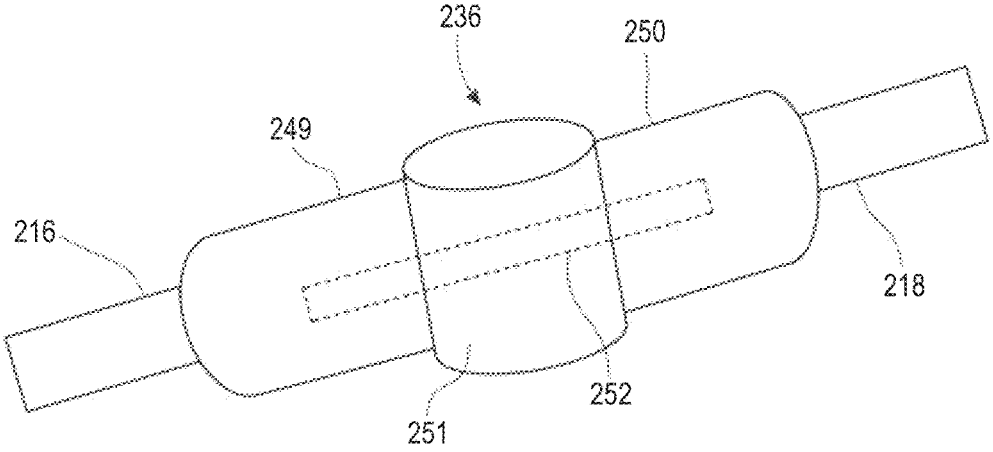
FIG. 9 illustrates a side view of a coupling assembly according to a non-limiting embodiment.

An example of a coupling assembly 236 is shown in FIG. 9. The coupling assembly 236 has a first end 249 for engaging one of the frame segments 216 and a second end 250 for engaging another of the frame segments 218. A joint 251 is provided that allows the first and second ends 249, 250 to move independently of each other. For example, the first and second ends 249, 250 may be attached to the joint 251 in a hinged manner or other configuration that permits the first and second ends 249, 250 to move independently. A biasing member 252 is positioned to apply force so that the frame segments 216, 218 are naturally moved away from each other. An amount that each coupling device expands may be limited by its design. For example, the coupling assembly 236 can be configured so that when fully expanded, an angle between the frame segments 216, 218 is less than 180 degrees, as shown by the coupling assembly 236 in FIG. 8.

When the frame segments 216, 218, 220, 222, 224 are in a collapsed configuration, as discussed below in more detail, the coupling assemblies 236, 240, 244, 248 are contracted such that their biasing members 252 are in a state of elastic deformation to store potential energy. This potential energy is released when forces holding the coupling assemblies 236, 240, 244, 248 in the contracted position are released, such as when the nursing device 200 is expanded. In an embodiment, the cover portion 208 and/or wall 210 may include openings 253, shown in FIG. 7, to avoid interference with the coupling assemblies 236, 240, 244, 248. A storage clip 254 may be positioned on the frontmost segment 220 to hold the segments 216, 218, 220, 222, 224 together when in the collapsed configuration, as discussed below in more detail The frame segments 216, 218, 220, 222, 224 may be attached directly or indirectly to the material forming the cover portion 208 and/or wall 210 using adhesives, including those that are non-toxic. The frame segments 216, 218, 220, 222, 224 may also be sewn in place or inserted into a sheath or sleeve that is sewn to the cover portion 208 or the wall 210. In an embodiment, loops may be formed, similar to belt loops, in the cover portion 208 and/or the wall 210 to maintain the frame segments 216, 218, 220, 222, 224 in place.

As shown in FIGS. 7 and 8, the cover portion 208 comprises sections that correspond to the frame segments 216, 218, 220, 222, 224. Starting at termination end 232 of the frame 204, an upper left rear section 256 is positioned above the first frame segment 224, and an upper left side section 260 is positioned above the second frame segment 222. An upper front section 264 of the cover portion 208 is positioned above the third frame segment 220. Moving further around the arch of the frame 204, the cover portion 208 has an upper right front section 268 and an upper right rear section 272 that are configured symmetrically to those on the left side of the nursing device 200. As shown in FIG. 8, the upper left rear section 256 and the upper right rear section 272 have sides 276, 280 that curve inwardly to form a wing-like shape.

The wall 210 may include sections that correspond to the sections of the cover portion 208. For example, as shown in FIG. 7, starting at termination end 232 of the frame 204, a lower left rear section 284 of the wall 210 is positioned below the first frame segment 224, and a lower left side section 288 is positioned below the second frame segment 222. A lower front section 292 of the wall 210 is positioned below the third frame segment 220. Moving further around the arch of the frame 204, the wall 210 has a lower right side section and a lower right rear section (not shown) that are configured symmetrically similar to the lower left side and lower left rear sections 284, 288. In an embodiment, the termination end 228 of the frame 204, shown in FIG. 8, will be aligned with a user's right shoulder during use and the termination end 232 of the frame 204 will be aligned with a user's left shoulder, such that the frame 204 and the wall 210 do not extend along the user's back.

The viewing window 212 is defined by a recessed area of the upper front section 264 of the cover portion 208 and includes a rim 296 with a fastening configuration 300. The fastening configuration 300 may include a plurality of adjustable straps. In an embodiment, the straps of the fastening configuration 300 can be secured to each other using, for example, hook and loop fasteners, buttons, and the like. A circumference of the rim 296 can be adjusted by changing an amount that the straps overlap with each other. The size of the viewing window 212 may be changed to adjust fitment of the nursing device 200 and/or adjust the field of view with respect to the baby and the user's breasts. In an embodiment, the rim 296 of the viewing window 212 may extend to the rear beyond the terminal ends 228, 232 of the frame 204, as shown in FIG. 8.

Figure 10:
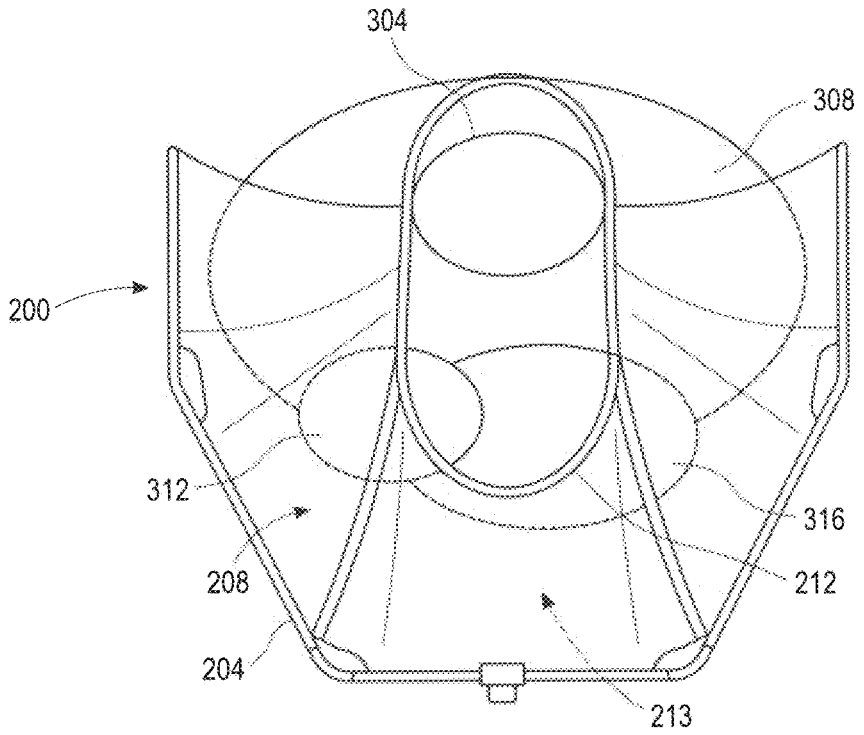
FIG. 10 illustrates a top view of the nursing device in FIG. 7 with silhouettes of a mother and baby according to a non-limiting embodiment.

FIG. 10 depicts boundary areas of the user and baby. For example, boundary area 304 represents the user's head, boundary area 308 represents the user's body, including the breast area. Boundary area 312 represents the baby's head, and boundary area 316 represents the baby's body. As shown, the cover portion 208 contributes to forming the interior cavity 213 and provides privacy for the user's breast area, while the viewing window 212 permits the user to see the baby 312, 316 and breast area 308 during a feeding session. Sufficient space exists between the baby 312, 316 and the frame 204 to allow the user to move their arms and reposition the baby 312, 316 as needed.

The nursing device 200 is transformable from the open configuration, shown in FIGS. 7, 8 and 10, to a collapsed configuration for easy storage and transportation. In the open configuration, the coupling members are biased to an expanded state that forces the frame segments 216, 218, 220, 222, 224 away from each other such that the cover portion 208 extends radially to form a roof including the viewing window 212. In an embodiment, each of the segments 216, 218, 220, 222, 224 extends in different directions. The wall 210 has a bottom edge 324 in the open position, shown in FIG. 7, that hangs downwardly and extends around front and side portions of the user. In an embodiment, as an example, a height of the wall 210 in the open configuration is approximately 46 cm and a widest portion of the device, from coupling assembly 236 to coupling assembly 248, shown in FIG. 8, may be between 55 cm-66 cm. As another example, a distance from the front segment 220 to a rearmost portion of the device may be between 55 cm-66 cm.

Figure 11A:
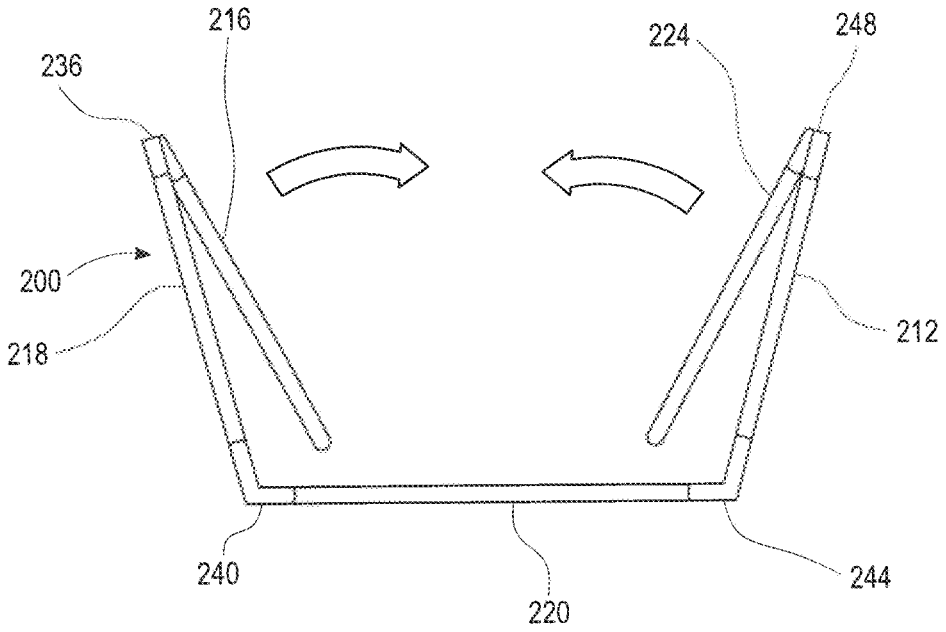
FIGS. 11A and 11B illustrate top views of the nursing device of FIG. 7 being folded into a collapsed position.
Figure 11B:
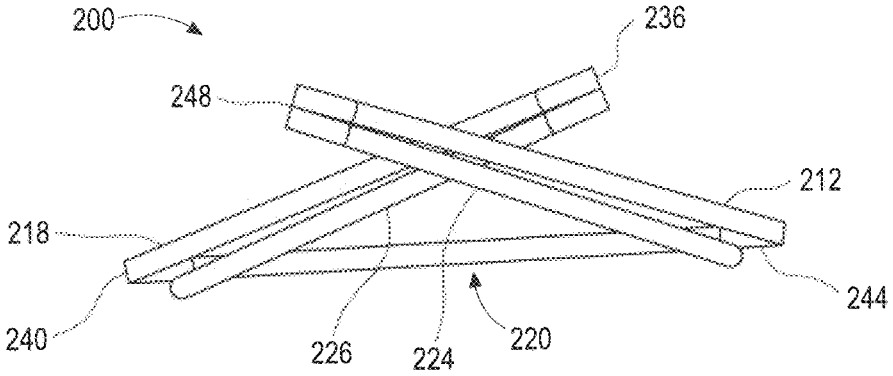

With reference to FIG. 11A, the nursing device 200 is transitioned from the open configuration to the collapsed configuration by folding frame segments 216, 224, respectively, onto segments 218, 222. Folding of the segments 216, 218, 222, 224 is facilitated by the coupling assemblies 236, 240, 244, 248. Segments 216, 218, 222, 224 are then folded onto segment 220, as shown in FIG. 11B. The frame segments 216, 218, 220, 222, 224 are shown in isolation for clarity of illustration. The frame segments 216, 218, 220, 222, 224 fold in the same manner with the cover portion 208 and the wall 210 attached.

Figure 12A:
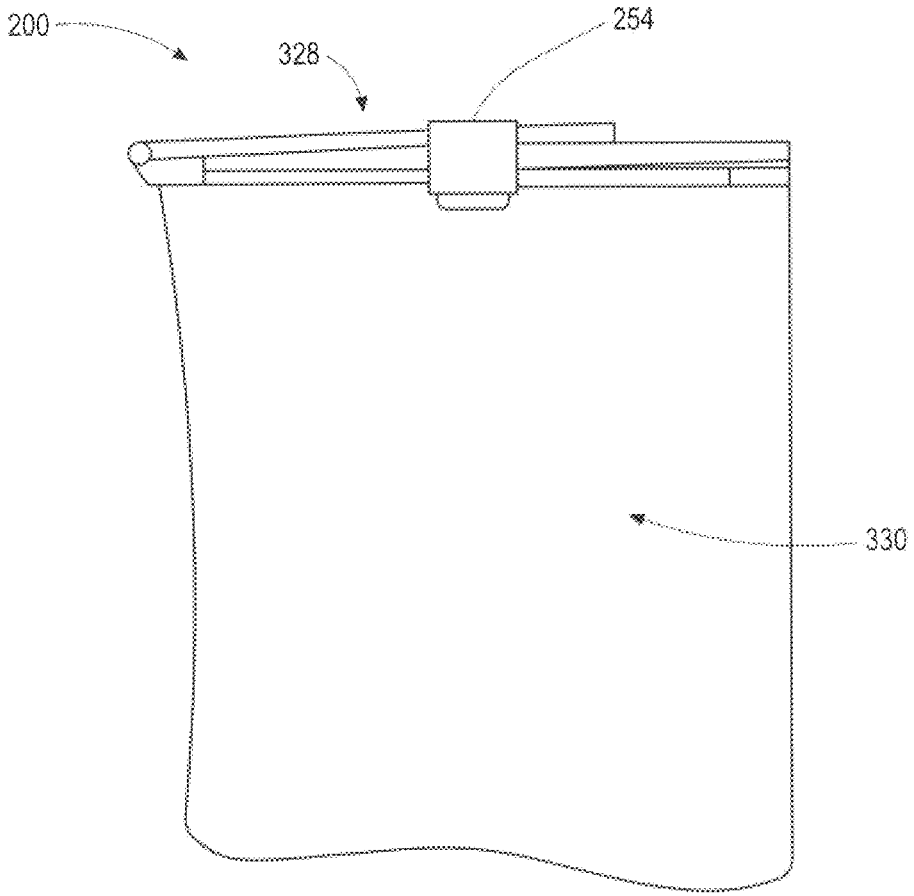
FIGS. 12A and 12B illustrate side views of the nursing device of FIG. 7 in collapsed positions.
Figure 12B:
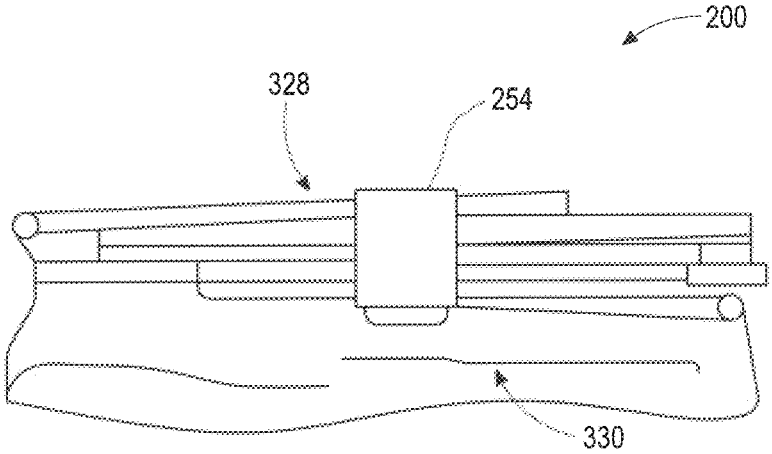

As shown in FIG. 12A, frame segments 216, 218, 220, 222, 224, collectively represented by numeral 328, are in a contracted state such that longitudinal sides of the segments 328 are disposed adjacent to each other. The material forming the cover portion 208 and the wall 210, illustrated generally as 330, remains coupled to the segments 328 and hangs downwardly so that it can be rolled or bunched into the configuration shown in FIG. 12B. The storage clip 254 holds the grouped segments 328 together in a secured configuration to help prevent unwanted expansion of the device 200.

Figure 13:
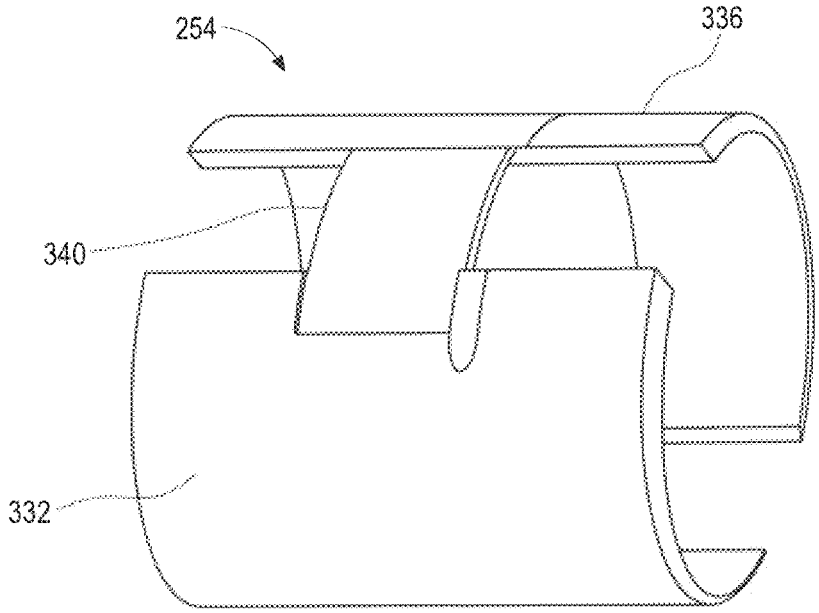
FIG. 13 illustrates a perspective view of a storage clamp for a nursing device according to a non-limiting embodiment.
Figure 14:
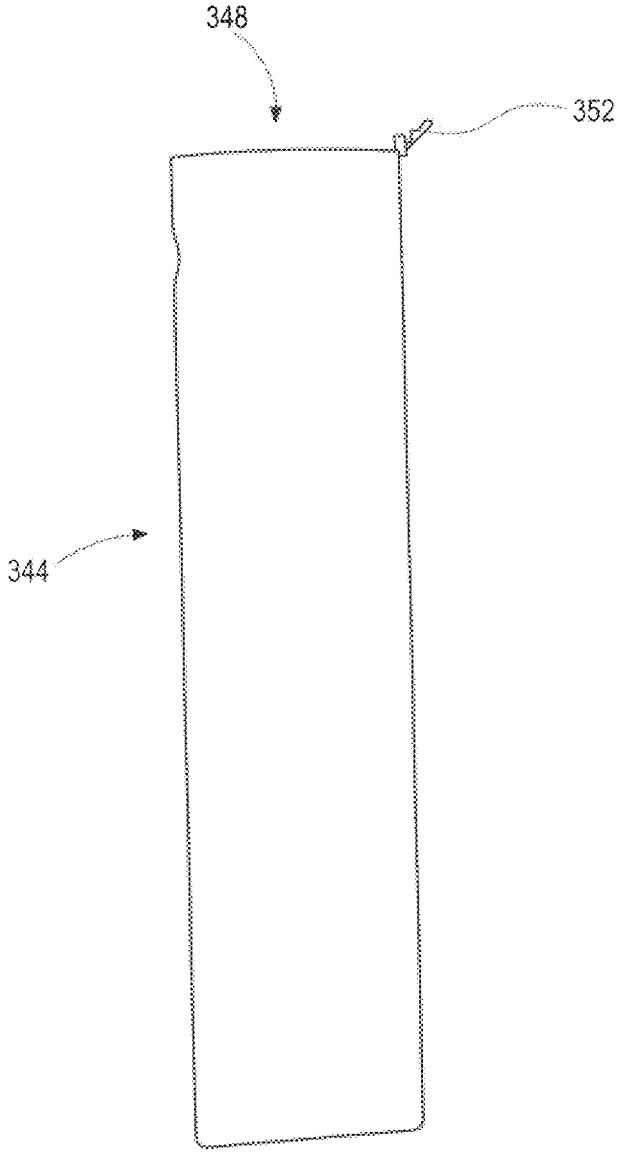
FIG. 14 illustrates a side view of a storage bag for a nursing device according to a non-limiting embodiment.

With additional reference to FIG. 13, the storage clip 254 may have first and second curved portions 332, 336 connected by a tab 340. The curved portions 332, 336 surround the collapsed segments 328 to hold them in place, allowing the device 200 to be neatly placed into a storage bag. An example of a storage bag 344 is shown in FIG. 14. The storage bag 344 may have an opening 348 for inserting the device 200 and a draw string 352, or other similar configuration, for reducing the size the opening 348 to help maintain the device 200 in the bag 344.

As will be apparent to one of ordinary skill in the art from a reading of this disclosure, the present disclosure can be embodied in forms other than those specifically disclosed above. The particular embodiments described above are, therefore, to be considered as illustrative and not restrictive. Those skilled in the art will recognize, or be able to ascertain, using no more than routine experimentation, numerous equivalents to the specific embodiments described herein. The scope of the invention is as set forth in the appended claims and equivalents thereof, rather than being limited to the examples contained in the foregoing description.

The invention claimed is:

1. A wearable nursing device collapsible from an open configuration to a collapsed configuration, the nursing device comprising:

a wall forming front and side portions of the device, the wall having an upper rim and a lower rim;

a flexible frame comprising an upper leg adjacent the upper rim and a lower leg adjacent the lower rim; and a cover attached to the wall, the cover being mountable on a person and including a viewing window, wherein in the open configuration the frame is biased to an expanded state that extends the cover in an outwardly direction to define an interior cavity between the cover and the wall, wherein in the collapsed configuration, the flexible frame is folded onto itself, and wherein a center of the flexible frame is at a front portion of the nursing device, and the wall is split to create an opening opposite the front portion, the opening being defined by opposing ends of the wall, and wherein a fastener is attached to the opposing ends of the wall to adjust an amount of space between the opposing ends.

2. The nursing device of claim 1, wherein the flexible frame in the open configuration comprises an oval loop with curved end portions, the upper leg extending between tops of the curved end portions and the lower leg extending between bottoms of the curved end portions.

3. The nursing device of claim 1, wherein the flexible frame comprises a spring wire.

4. The nursing device of claim 1, wherein in the collapsed position, the flexible frame forms two adjacent loops.

5. The nursing device of claim 1, wherein the viewing window has a curved circumferential rim for encircling a user's neck, the viewing window being defined in part by straps that extend from the cover, the straps being releasably attached to each other.

6. The nursing device of claim 5, wherein the straps are attached to each other using a hook and loop fastener.

7. The nursing device of claim 1, wherein the fastener comprises a string that extends through holes in the wall to form a zigzag pattern.

8. The nursing device of claim 1, wherein the viewing window has a rim, and an open space exists between a back portion of the rim and the opposing ends of the wall.

9. The nursing device of claim 1, wherein the flexible frame forms a single continuous loop in the open configuration.

10. The nursing device of claim 1, wherein in the open configuration during use, the wall is forced downwardly such that the wall would block a nursing child from being seen from the front and side portions of the nursing device while not covering a user's knees when the user is standing.

11. The nursing device of claim 1, wherein the cover and wall comprise fabric material.

12. A wearable nursing device collapsible from an open configuration to a collapsed configuration, the nursing device comprising:

a wall forming front and side portions of the device, the wall having an upper rim and a lower rim;

a flexible frame comprising an upper leg adjacent the upper rim and a lower leg adjacent the lower rim; and a cover attached to the wall, the cover being mountable on a person and including a viewing window, wherein in the open configuration the frame is biased to an expanded state that extends the cover in an outwardly direction to define an interior cavity between the cover and the wall, wherein in the collapsed configuration, the flexible frame is folded onto itself, and wherein the viewing window has a curved circumferential rim for encircling a user's neck, the viewing window being defined in part by straps that extend from the cover, the straps being releasably attached to each other.

13. The nursing device of claim 12, wherein the flexible frame in the open configuration comprises an oval loop with curved end portions, the upper leg extending between tops of the curved end portions and the lower leg extending between bottoms of the curved end portions.

14. The nursing device of claim 12, wherein the flexible frame comprises a spring wire.

15. The nursing device of claim 12, wherein in the collapsed position, the flexible frame forms two adjacent loops.

16. The nursing device of claim 12, wherein the straps are attached to each other using a hook and loop fastener.

17. The nursing device of claim 12, wherein a center of the flexible frame is at a front portion of the nursing device, and the wall is split to create an opening opposite the front portion, the opening being defined by opposing ends of the wall, and wherein a fastener is attached to the opposing ends of the wall to adjust an amount of space between the opposing ends.

18. The nursing device of claim 17, wherein the fastener comprises a string that extends through holes in the wall to form a zigzag pattern.

19. The nursing device of claim 12, wherein the viewing window has a rim, and an open space exists between a back portion of the rim and the opposing ends of the wall.

20. The nursing device of claim 12, wherein the flexible frame forms a single continuous loop in the open configuration.

21. The nursing device of claim 12, wherein in the open configuration during use, the wall is forced downwardly such that the wall would block a nursing child from being seen from the front and side portions of the nursing device while not covering a user's knees when the user is standing.

22. The nursing device of claim 12, wherein the cover and wall comprise fabric material.

23. A wearable nursing device collapsible from an open configuration to a collapsed configuration, the nursing device comprising:

a wall forming front and side portions of the device, the wall having an upper rim and a lower rim;

a flexible frame comprising an upper leg adjacent the upper rim and a lower leg adjacent the lower rim; and a cover attached to the wall, the cover being mountable on a person and including a viewing window, wherein in the open configuration the frame is biased to an expanded state that extends the cover in an outwardly direction to define an interior cavity between the cover and the wall, wherein in the collapsed configuration, the flexible frame is folded onto itself, and wherein in the open configuration during use, the wall is forced downwardly such that the wall would block a nursing child from being seen from the front and side portions of the nursing device while not covering a user's knees when the user is standing.

24. The nursing device of claim 23, wherein the flexible frame in the open configuration comprises an oval loop with curved end portions, the upper leg extending between tops of the curved end portions and the lower leg extending between bottoms of the curved end portions.

25. The nursing device of claim 23, wherein the flexible frame comprises a spring wire.

26. The nursing device of claim 23, wherein in the collapsed position, the flexible frame forms two adjacent loops.

27. The nursing device of claim 23, wherein the viewing window has a curved circumferential rim for encircling a user's neck, the viewing window being defined in part by straps that extend from the cover, the straps being releasably attached to each other.

28. The nursing device of claim 27, wherein the straps are attached to each other using a hook and loop fastener.

29. The nursing device of claim 23, wherein a center of the flexible frame is at a front portion of the nursing device, and the wall is split to create an opening opposite the front portion, the opening being defined by opposing ends of the wall, and wherein a fastener is attached to the opposing ends of the wall to adjust an amount of space between the opposing ends.

30. The nursing device of claim 29, wherein the fastener comprises a string that extends through holes in the wall to form a zigzag pattern.

31. The nursing device of claim 23, wherein the viewing window has a rim, and an open space exists between a back portion of the rim and the opposing ends of the wall.

32. The nursing device of claim 23, wherein the flexible frame forms a single continuous loop in the open configuration.

33. The nursing device of claim 23, wherein the cover and wall comprise fabric material.

* * * * *